United States Patent [19]

Becker

[11] Patent Number: 4,801,905

[45] Date of Patent: Jan. 31, 1989

[54] MICROSTRIP SHIELDING SYSTEM

[75] Inventor: Alvin G. Becker, Loveland, Colo.

[73] Assignee: Hewlett-Packard Company, Palo Alto, Calif.

[21] Appl. No.: 41,883

[22] Filed: Apr. 23, 1987

[51] Int. Cl.[4] ..... H01P 3/08

[52] U.S. Cl. ..... 333/238; 333/246; 174/117 FF; 174/36

[58] Field of Search ..... 333/246, 238, 1, 247; 174/117 F, 117 FF, 36; 439/607

[56] References Cited

U.S. PATENT DOCUMENTS

| | | | |
|---|---|---|---|
| 2,825,042 | 2/1958 | Tollefson et al. | 439/607 |
| 2,926,317 | 2/1960 | Blitz | 333/238 |
| 3,093,805 | 6/1963 | Osifchin et al. | 333/238 X |
| 3,149,893 | 9/1964 | Dupre | 439/607 X |
| 3,587,029 | 6/1971 | Knowles | 439/607 |
| 3,863,181 | 1/1975 | Glance et al. | 333/246 X |
| 4,149,026 | 4/1979 | Fritz et al. | 333/246 X |
| 4,187,480 | 2/1980 | Frazita | 333/246 X |
| 4,281,302 | 7/1981 | Stegens | 333/246 X |
| 4,394,633 | 7/1983 | Klein | 333/246 X |
| 4,441,088 | 4/1984 | Anderson | 174/117 FF |
| 4,605,915 | 8/1986 | Marshall et al. | 333/238 |

*Primary Examiner*—Eugene R. LaRoche
*Assistant Examiner*—Seung Ham
*Attorney, Agent, or Firm*—Edward L. Miller

[57] ABSTRACT

A shielded printed circuit board system is described in which a microstrip transmission line secured to the surface of a dielectric substrate between ground planes is shielded to isolate the microstrip and inhibit the escape of electromagnetic radiation. This system reduces crosstalk in printed circuit boards and also reduces coupling of external fields into the signal path, thus allowing more sensitive measurements. The shield member is conductive and includes a body section and downwardly depending leg members. The leg members are secured to ground planes on each side of the microstrip transmission line. In another embodiment a dimensionally stable support plate (e.g., an aluminum plate) is secured over the shield member.

34 Claims, 3 Drawing Sheets

MICROSTRIP SHIELDING SYSTEM

FIELD OF THE INVENTION

This invention relates to printed circuit boards. More particularly, this invention relates to techniques for reducing crosstalk in printed circuit boards and reducing escape of electromagnetic radiation from printed circuit boards. Even more particularly, this invention relates to shielding of microstrip transmission lines.

BACKGROUND OF THE INVENTION

An inherent limitation of conventional printed circuit boards is the tendency of microstrip transmission lines to allow escape of electromagnetic radiation into the environment. This is very undesirable and can cause interference with radio and television operations, for example. Also, when microstrip transmission lines are located close to each other on a printed circuit board, electromagnetic fields in adjacent microstrips can become coupled, i.e, there is crosstalk between adjacent microstrips. This is also very undesirable.

Basically, any electromagnetic interference with the signal in a microstrip transmission line is undesirable and can amount to more than just an annoyance. Such type of interference can easily prevent the measurement of sensitive signals in a given microstrip.

One conventional technique which is used in the electronic industry involves multi-layer printed circuit boards in which several printed circuit boards are sandwiched together, one on top of another. Although such an arrangement does provide a certain amount of shielding of the microstrip transmission lines, there are several disadvantages associated with multi-layer systems. For example, the cost of such systems is relatively high. Crosstalk is still a problem due to exposed connector and component pins. Also, there is poor control of characteristic impedance. Further, the multi-layer system is impractical for use at 75 ohm or higher impedance. Moreover, repair of various layers in the multi-layer system is very difficult because of the difficulty of separating the layers without causing damage to the circuits.

It is also possible to obtain shielding by using coaxial cables (i.e., shielded cable), but this requires hand wiring which is very time consuming and expensive. Consequently, this technique normally is used only in small circuits and does not lend itself to practical use in large circuits.

Another technique which has been used involves milling cavities in an aluminum plate and then placing the plate over the printed circuit board. The cost of milling the cavities is quite large, and some form of gasket or conductive adhesive must be used to fill the gaps between the plate and the printed circuit board due to board warp. This technique is practical only for small circuits in low volume production.

Another method for shielding which has been used involves the use of conductive elastomers which are molded and placed over the microstrips. This technique is also very expensive.

SUMMARY OF THE PRESENT INVENTION

In accordance the present invention there is provided a shielded printed circuit board system comprising:

(a) a printed circuit board comprising a conductive microstrip transmission line secured to one surface of a dielectric substrate between ground planes separated from the microstrip line on the substrate; and (b) a conductive shield member spaced above the microstrip transmission line, wherein the shield member includes downwardly depending leg members secured to the ground planes;

wherein the shield member is adapted to inhibit escape of electromagnetic radiation from the microstrip transmission line.

The shield concept of this invention is also useful with respect to printed circuit boards having a plurality of microstrip transmission lines on it. Where multiple microstrips are on a printed circuit board, a separate shield member is secured over each microstrip line to shield each such line.

Preferably a dimensionally stable support plate (e.g., an aluminum plate) is placed over the shield member and then secured to the printed circuit board. This support plate protects and mechanically locates the shield member, and controls the distance between the shield member and the printed circuit board in order to assure proper control over the impedance of the microstrip transmission line.

The shield member is made of a conductive material. The main body section of the shielded and the downward depending legs effectively reduce or prevent escape of electromagnetic radiation from the microstrip transmission line. Thus, the shield reduces or eliminates crosstalk between adjacent microstrips. The shield also prevents electromagnetic interference and coupling of electromagnetic fields in adjacent microstrips. Accordingly, use of the shielding system of this invention allows more sensitive measurements to be made because there is no interference from other microstrip signals.

The shielding system of the invention is lower in cost than other systems for reducing electromagnetic interference (e.g., multi-layer printed circuit boards). It is also more effective at reducing crosstalk than all but the most expensive systems.

The shielding system of the invention also enables the impedance of the microstrip transmission line to be easily controlled in manufacture. One reason is the use of 2-layer printed circuit boards, which have much better tolerances on thickness and dielectric constant compared to multilayer boards. Another reason is that the trace widths can be larger than normally used in printed circuit boards of the multi-layered type, which reduces the effects of variation in the trace width. The wider trace width also permits a wider range of characteristic impedances than would be possible with multilayer boards. For example, impedances above 75 ohms or so on multilayer boards require narrower trace widths than are commercially practical.

Another advantage of the shielding system of this invention is that the shield can be easily removed without damaging the circuitry. This feature enables the circuitry to be repaired, if necessary. This feature is not typical of conventional multi-layered printed circuit boards.

Still another advantage of the shielding system is that it can be easily used on large or repetitive circuits.

Other advantages of the shielding system of the invention will be apparent from the following detailed description.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
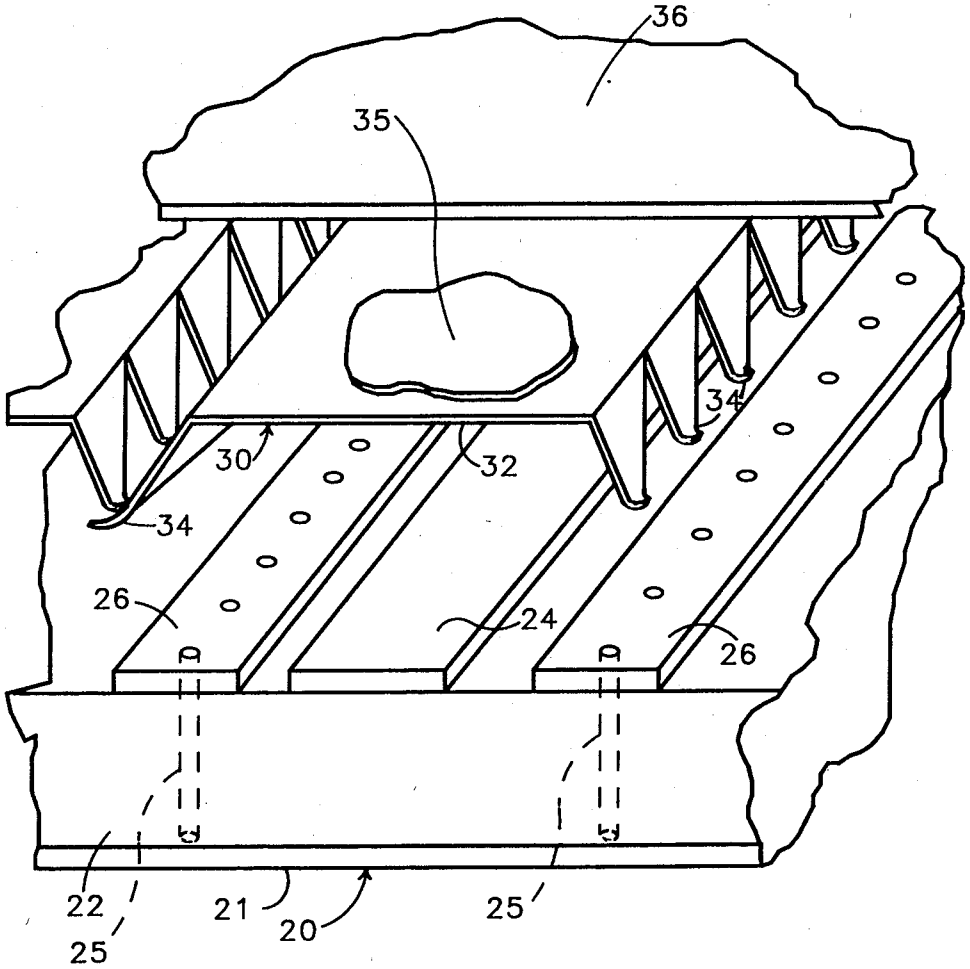
FIG. 1 is an explosion view illustrating the microstrip transmission line shielding system of the invention.

Thus, in the drawings there is illustrated a microstrip shielding system 10 of the invention in which printed circuit board 20 includes a conventional dielectrical substrate 22. To one surface of the substrate 22 there is secured a microstrip transmission line 24 which is located between and spaced from ground planes 26. On the lower surface of the dielectric substrate there is a large ground plane 21. Plated-through holes 25 extend through the dielectric substrate 22 to electrically connect ground planes 26 on the upper surface of the substrate and ground plane 21 on the lower surface.

Conductive shield member 30 is spaced above each microstrip transmission line 24 to reduce or inhibit electromagnetic radiation from escaping into the environment. The shield member 30 includes an elongated, generally planar body section 32 and downwardly depending leg members 34. The leg members depend from each side edge of the body section 32.

The body section 32 is preferably disposed parallel to and spaced above the microstrip line, as illustrated. The depending leg members 34 contact the ground planes 26 on each side of the microstrip line.

Normally there are a plurality of microstrip lines 24 on each printed circuit board. Typically, the microstrip lines are parallel to each other, although this is not always the case. As illustrated in the drawings, the fingers 34 of one shield member 30 are adapted to be interleaved with like fingers of an adjacent shield member covering an adjacent microstrip line.

With this arrangement each microstrip line is effectively shielded to prevent escape of electromagnetic radiation. This prevents cross talk between microstrip lines and also prevents coupling of electromagnetic fields in adjacent microstrips. Thus, interference is reduced or eliminated.

The shield member is conductive and is composed of a metal. A particularly preferred metal for this purpose is an alloy of beryllium and copper which has very good resiliency properties (i.e., it has a desirable springy characteristic). This characteristic assures that the leg members maintain good contact with the ground planes in the system. Alloys of this type are commercially available, for example, from Instrument Specialities Co., Inc. The ¼-hard alloy is preferred because no heat-treating is required after forming the shield member. The beryllium-copper alloy is also preferred for use as the shield member because it can be easily photo-etched. This enables the blank sheet to be imaged and then etched to obtain the desired shield blank pattern or shape.

Then the shield blank is electroplated with tin or similar material to prevent galvanic corrosion at the points where the ends of the leg members contact the ground planes on the printed circuit board. The ground planes are normally coated with tin/lead solder. If desired, only the tips of the leg members may be plated with tin.

After the shield blank has been electroplated it is put into a forming die where the leg members are bent or formed to the desired shape. Preferably the die comprises steel on one side, to define the final formed shape. The other side of the die may be made of urethane rubber or similar material, to avoid the need for precision mechanical matching of the die halves.

Other metals may also be used for the shield member. For example, other such metals include copper, tin, steel, stainless steel, brass, aluminum, and the like. Also, useful metals include various alloys of these metals.

The thickness of the shield member may vary. Typically thickness is in the range of about 0.002 to 0.02 inch, although greater thicknesses could be used, if desired.

The leg members are preferably integral with the body section of the shield member. The leg members may be continuous walls along each side edge, if desired, or they may be individual members, as illustrated. The leg members may have any desired shape, e.g., triangular, rectangular, etc. A triangular shape works well because the leg members of adjacent shields can be interleaved to effectively shield the microstrip lines by forming a more complete wall or barrier.

The shield member is normally parallel to and spaced above the microstrip line in the manner illustrated. Preferably the shield member is spaced above the microstrip by at least about 0.02 inch. A practical maximum spacing of the shield member above the microstrip is about 0.25 inch. Although greater spacing could be used, there is no significant advantage obtained, and the packaging takes up more space.

When there are a plurality of individual leg members along each side of the shield member it is preferred that they be spaced closely together. The spacing between the outer ends of the leg members should be less than ¼ of the wavelength of the signal being transmitted in the microstrip line. Even more preferably the spacing between adjacent leg members should be less than about 1/25 of the wavelength of the signal. For example, when the signal is 1 gigahertz, the spacing between leg members is about 0.2 inch. Generally speaking, the spacing between adjacent leg members is less than about one inch, and normally less than about 0.5 inch for most uses.

In the shielding system of the invention it is preferred to place a support plate 36 over the shield member 30. The support plate is dimensionally stable and preferably is planar. The main purpose of the support plate is to provide support and rigidity to the shield member.

The support plate does not have to be conductive. For example, it may be made of metal, or plastic, or cardboard, or masonite, etc. A preferred material is an aluminum plate. The thickness of the support plate is not critical. Typical thicknesses are in the range of about 0.04 to 0.125 inch.

The lower surface of the support plate is normally adhered to the top surface of the shield member (e.g., by means of an adhesive 35 which need not be conductive). The support plate is secured to the printed circuit board (preferably by means of rivets or threaded fasteners, etc., screws).

Figure 2:
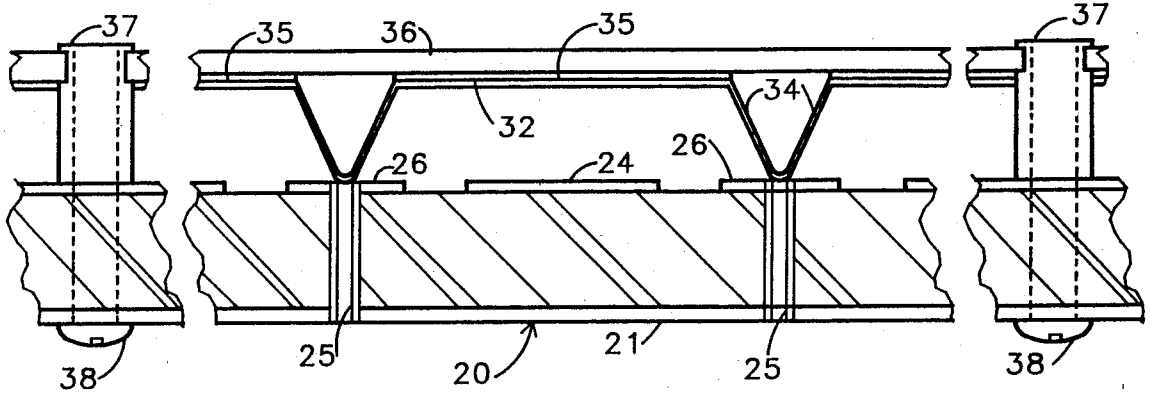
FIG. 2 is a cross sectional view of the shielding system shown in FIG. 1.

It is also preferred for the lower surface of the support plate to include spacers which are adapted to rest upon the printed circuit board at various locations between certain adjacent shield members. This is also illustrated in FIG. 2 where spacers 37 are shown fastened to the under surface of support plate 36. The spacers rest against the upper surface of the printed circuit board 20. Threaded screws 38 extend through board 20 and are threadably received in spacers 37 to secure the support plate.

Figure 3:
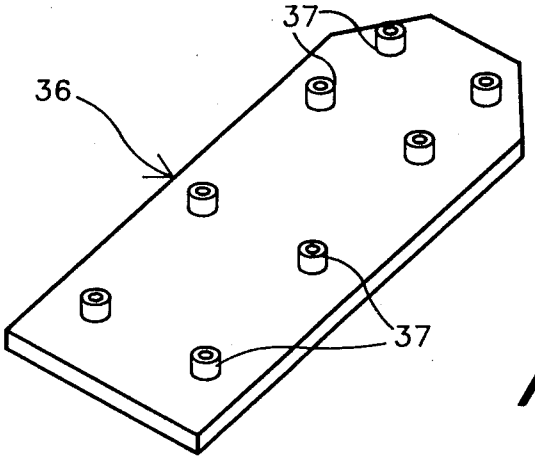
FIG. 3 is a perspective view of one type of support plate which is useful in the present invention.

The purpose of the spacers 37 is to determine proper vertical spacing between the shield member and the printed circuit board in the final assembly. This assures proper control over the impedance of the microstrip line. Also, as the support plate is secured to the printed circuit board the support plate urges the legs of the shield member against the appropriate ground planes 26. This assures that all of the leg members are in good contact with the ground planes. FIG. 3 is a perspective view of one type of support plate 36 with spacers 37 secured to its underside.

Although it is possible to solder the tip of each leg member to the ground planes, this requires more time and effort. A conductive adhesive could also be used for this purpose, but much time would be required.

As stated above, the preferred method for securing the shield member to the printed circuit board is by the use of threaded fasteners or rivets. Another alternative is to clamp the perimeter of the support plate to the printed circuit board. These techniques allow the support plate and shield to be removed to facilitate repair of the circuitry on the printed circuit board, if necessary.

The width and length of each shield member may vary, depending upon the width and length of the microstrips to be shielded. Typically the shield member has a width in the range of about 0.1 to 1.0 inch and a length in the range of about 0.5 to 20 inches. Any number of these shield members may be formed on a single blank and attached to a single support plate.

Several shield members may be included in a structure. For example, a blank sheet of conductive metal as large as the entire circuit board to be shielded may be placed in a die and pressed, whereby a plurality of individual leg members are formed (for example, in parallel rows) which are still integral with the metal sheet. In this case the plane of the metal sheet serves as the body section for a plurality of shield members. The edges of the metal sheet are also bent downwardly and cut at spaced intervals to form additional leg members. The end result is a master shield member which covers the entire circuit board, with each separate microstrip being shielded by separate areas of the master shield. Also, the leg members along the edges of the master shield contact ground planes at the edges of the printed circuit board and thus serve to shield the entire board.

Other variants are possible without departing from the scope of the present invention.

What is claimed is:

1. A shielded printed circuit board system comprising:

(a) a printed circuit board comprising a conductive microstrip transmission line secured to one surface of a dielectric substrate between ground planes separated from said microstrip line on said substrate; and (b) a conductive shield member spaced above said microstrip transmission line, wherein said shield member includes downwardly depending leg members secured to said ground planes; wherein said shield member includes an elongated body section having first and second edges; wherein said body section is generally planar and is disposed parallel to said microstrip transmission line; wherein there are a plurality of said downwardly depending leg members attached to said first edge of said body section and a plurality of said leg members attached to said second edge of said body section; wherein said leg members are integral with said body section and are springy;

wherein said shield member is adapted to inhibit escape of electromagnetic radiation from said microstrip transmission line.

2. A shielded printed circuit board system in accordance with claim 1, wherein said shield member comprises an alloy of beryllium and copper.

3. A shielded printed circuit board system in accordance with claim 1, wherein said shield member comprises tin.

4. A shielded print circuit board system in accordance with claim 1, wherein said shield member is composed of a metal selected from the group consisting of copper, tin, brass, steel, stainless steel, and aluminum, or alloys thereof.

5. A shielded printed circuit board system in accordance with claim 1 wherein said leg members include upper and lower ends, wherein said upper ends are attached to said body section; and wherein said lower ends are narrower than said upper ends.

6. A shielded printed circuit board system in accordance with claim 1, wherein the spacing between adjacent leg members is less than about 0.5 inch.

7. A shielded printed circuit board system in accordance with claim 5, wherein said leg members are triangular.

8. A shielded printed circuit board system in accordance with claim 1, wherein said leg members are rectangular.

9. A shielded printed circuit board system in accordance with claim 1, wherein said shield member has a thickness in the range of about 0.002 to 0.02 inch.

10. A shielded printed circuit board system in accordance with claim 1, wherein said body section of said shield member is spaced above said microstrip transmission line a distance in the range of about 0.02 to 0.025 inch.

11. A shielded printed circuit board system in accordance with claim 1, wherein said leg members comprise an alloy of beryllium and copper, and wherein said leg members bear an overlayer comprising tin.

12. A shielded printed circuit board system in accordance with claim 1, wherein said leg members comprise continuous wall sections.

13. A shielded printed circuit board system in accordance with claim 1, wherein said printed circuit board includes a plurality of said microstrip transmission lines parallel to each other; wherein each said microstrip transmission line is secured to said dielectric substrate between ground planes; and wherein each said microstrip transmission line is shielded by a said shield member.

14. A shielded printed circuit board system in accordance with claim 13, wherein each said shield member comprises a metal selected from the group consisting of beryllium-copper alloy, copper, brass, steel, stainless steel, tin, and aluminum, or alloys thereof.

15. A shielded printed circuit board system in accordance with claim 13, further comprising a dimensionally stable support member secured to said printed circuit board and being disposed over said shield member.

16. A shielded printed circuit board system in accordance with claim 15, wherein said support member comprises an aluminum plate.

17. A shielded printed circuit board system comprising:

(a) a printed circuit board comprising a conductive microstrip transmission line secured to one surface of a dielectric substrate between ground planes separated from said microstrip line on said substrate;

(b) a conductive shield member spaced above said microstrip transmission line for inhibiting escape of electromagnetic radiation from said microstrip transmission line; wherein said shield member comprises an elongated, generally planar body section having first and second opposite side edges; wherein said body section is disposed parallel to said microstrip transmission line; wherein downwardly projecting leg members are integral with each of said side edges of said body section; wherein said leg members are springy and are secured to said ground planes; and (c) a dimensionally stable support plate secured to said printed circuit board and being disposed over said shield member.

18. A shielded printed circuit board system in accordance with claim 17, wherein said shield member comprises a metal selected from the group consisting of beryllium-copper alloy, copper, brass, steel, stainless steel, tin, and aluminum.

19. A shielded printed circuit board system in accordance with claim 17, wherein said leg members include upper and lower ends, and wherein said upper ends are attached to said body section.

20. A shielded printed circuit board system in accordance with claim 19, wherein said leg members are triangular.

21. A shielded printed circuit board system in accordance with claim 17, wherein said printed circuit board includes a plurality of said microstrip transmission lines parallel to each other; wherein each said microstrip transmission line is secured to said dielectric substrate between ground planes; and wherein each said microstrip transmission line is shielded by a said shield member.

22. A shielded printed circuit board system in accordance with claim 17, wherein said shield member has a thickness in the range of about 0.002 to 0.02 inch.

23. A shielded printed circuit board system in accordance with claim 17, wherein said body section of said shield member is disposed parallel to said microstrip transmission line and is spaced above said line a distance in the range of about 0.02 to 0.25 inch.

24. A shielded printed circuit board system in accordance with claim 17, wherein said leg members comprise continuous wall sections.

25. A shielded printed circuit board system in accordance with claim 17, wherein said support plate comprises an aluminum plate which is secured to said printed circuit board by means of threaded fasteners.

26. A shielded printed circuit board system in accordance with claim 25, wherein said aluminum plate includes downwardly projecting spacer members which contact said ground planes on said printed circuit board.

27. A method for shielding a conductive microstrip transmission line secured to one surface of a dielectric substrate between ground planes separated from said microstrip line on said substrate wherein said shield member inhibits escape of electromagnetic radiation from said microstrip transmission line, said method comprising the steps of:

(a) providing a conductive shield member which comprises an elongated, generally planar body section having first and second opposite side edges and downwardly depending leg members integral with said first and second side edges of said body section; wherein said leg members are springy; and (b) securing said leg members of said shield member to said ground planes on each side of said microstrip transmission line in a manner such that said body section is disposed parallel to said transmission line.

28. A method in accordance with claim 27, wherein there are a plurality of said leg members attached to each said edge of said body section.

29. A method in accordance with claim 27, wherein said shield member comprises a metal selected from the group consisting of beryllium-copper alloy, copper, tin, brass, steel, stainless steel, and aluminum.

30. A method in accordance with claim 27, wherein said printed circuit board includes a plurality of said microstrip transmission lines and a plurality of said shield members, and wherein each said line is shielded by a said shield member.

31. A method in accordance with claim 28, wherein said leg members are triangular.

32. A method in accordance with claim 27, further comprising securing a dimensionally stable support plate to said printed circuit board over said shield member.

33. A method in accordance with claim 32, wherein said support plate is secured to said printed circuit board by means of threaded fasteners.

34. A method in accordance with claim 32, wherein said support plate comprises aluminum.

* * * * *